US010087026B2

(12) United States Patent
Morita

(10) Patent No.: US 10,087,026 B2
(45) Date of Patent: Oct. 2, 2018

(54) SHEET CONVEYING APPARATUS AND IMAGE FORMING APPARATUS INCLUDING THE SAME

(71) Applicant: Brother Kogyo Kabushiki Kaisha, Nagoya-shi, Aichi-ken (JP)

(72) Inventor: Tetsuya Morita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/629,803

(22) Filed: Jun. 22, 2017

(65) Prior Publication Data

US 2017/0369261 A1 Dec. 28, 2017

(30) Foreign Application Priority Data

Jun. 23, 2016 (JP) ..... 2016-124476

(51) Int. Cl.

| | |
|---|---|
| ***B65H 9/16*** | (2006.01) |
| ***B65H 85/00*** | (2006.01) |
| ***B65H 5/06*** | (2006.01) |
| ***B65H 15/00*** | (2006.01) |

(52) U.S. Cl.

CPC ..... *B65H 9/166* (2013.01); *B65H 5/062* (2013.01); *B65H 85/00* (2013.01); *B65H 2402/46* (2013.01); *B65H 2404/1316* (2013.01); *B65H 2404/13171* (2013.01)

(58) Field of Classification Search

CPC ..... B65H 5/062; B65H 2404/1316; B65H 2404/1317; B65H 2404/13171

See application file for complete search history.

(56) References Cited

U.S. PATENT DOCUMENTS 5,533,822 A * 7/1996 Tsukada ..... B41J 13/076 271/109
5,673,908 A * 10/1997 Nagata ..... B65H 3/10 271/107
7,210,678 B2 * 5/2007 Deshimaru ..... B65H 5/062 271/109

(Continued)

FOREIGN PATENT DOCUMENTS

| | | |
|---|---|---|
| JP | H11-139627 A | 5/1999 |
| JP | 2012-096862 A | 5/2012 |
| JP | 2016-137954 A | 8/2016 |

*Primary Examiner* — Patrick Cicchino
(74) *Attorney, Agent, or Firm* — Banner & Witcoff, Ltd.

(57) ABSTRACT

A sheet conveying apparatus includes a bottom plate, a side restriction member extending in a sheet conveying direction, a drive roller rotatable about a first axis substantially orthogonal to the sheet conveying direction, and a driven roller facing the drive roller and rotatable about a second axis inclined relative to the first axis. The driven shaft includes a shaft portion and an elastic portion. The shaft portion integrally includes a first extending portion, a second extending portion, and an intermediate portion located therebetween. The elastic portion is fitted over the intermediate portion. The first extending portion includes a first protruding portion. The second extending portion includes a second protruding portion. A first distance from the second axis to an outer peripheral surface of the first protruding portion is greater than a second distance from the second axis to an outer peripheral surface of the second protruding portion.

9 Claims, 8 Drawing Sheets

(56) References Cited

U.S. PATENT DOCUMENTS

| | | | | |
|---|---|---|---|---|
| 7,900,914 | B2 * | 3/2011 | Fujita | B65H 5/38 271/248 |
| 8,684,354 | B2 | 4/2014 | Iino et al. | |
| 8,874,021 | B2 * | 10/2014 | Sakaya | B65H 5/062 399/400 |
| 9,132,989 | B2 * | 9/2015 | Norikane | B65H 85/00 |
| 9,156,635 | B2 * | 10/2015 | Nguyen | B65H 85/00 |
| 9,527,689 | B2 | 12/2016 | Takami | |
| 2012/0104677 | A1 | 5/2012 | Iino et al. | |
| 2016/0214813 | A1 | 7/2016 | Takami | |

* cited by examiner

SHEET CONVEYING APPARATUS AND IMAGE FORMING APPARATUS INCLUDING THE SAME

CROSS-REFERENCE TO RELATED APPLICATION

This application claims priority from Japanese Patent Application No. 2016-124476 filed on Jun. 23, 2016, the content of which is incorporated herein by reference in its entirety.

FIELD OF DISCLOSURE

Aspects of the disclosure relate to a sheet conveying apparatus configured to convey a sheet and an image forming apparatus including the sheet conveying apparatus.

BACKGROUND

A known image forming apparatus is configured to form images on both surfaces of a sheet.

This kind of image forming apparatus includes a reverse conveying path. In a simplex printing mode, a sheet is fed to an image forming unit where an image is formed on a single surface of the sheet, and then the sheet having the image on the single surface is ejected onto the ejection tray. In a duplex printing mode, after an image is formed on a first surface of a sheet at the image forming unit, the sheet having the image on the first surface is conveyed via a reverse conveying path to the image forming unit. Through the reverse conveying path, the sheet is inverted so that a second surface faces the image forming unit. After an image is formed on the second surface of the sheet at the image forming unit, the sheet having the images on both first and second surfaces is ejected onto the ejection tray.

An angled roller set is disposed in the reverse conveying path for moving a sheet toward one side of the reverse conveying path in a width direction (orthogonal to a sheet conveying direction) while convening the sheet P. A side restriction member is disposed on one side relative to the angled roller set in the width direction. The angled roller set conveys a sheet while moving the sheet toward one side in the width direction until the sheet contacts the side regulation member, and the side regulation member restricts further movement of the sheet toward one side and maintains the orientation of the sheet.

The angled roller set includes a drive roller to which a drive force is transmitted and a driven roller configured to be driven by the drive roller. The drive roller has a resin-made rotation shaft around which a rubber is fitted. A rotation axis of the drive roller is parallel to the width direction. The driven roller has a shaft and a peripheral surface, which are combined with each other and made of resin. A rotation axis of the driven roller is inclined relative to the rotation axis of the drive roller. The rotation axis of the driven roller is inclined such that an end portion of the driven roller closer to one side (the side regulation member) in the width direction is more upstream in the sheet conveying direction.

In the above configuration, when the resin-made peripheral surface of the driven roller contacts a surface of a sheet having a relatively large filled-in area, the surface of the sheet is glazed and thus the driven roller may slip on the glazed surface, which may reduce a conveying force required for moving a sheet toward one side in the width direction.

SUMMARY

As a solution to reduce slippage between the driven roller and a sheet, the peripheral surface of the driven roller may be covered with rubber. As the rubber covering the driven roller increases the friction force between a sheet and the peripheral surface of the driven roller, a conveying force can be maintained. This structure, however, may cause lopsided wear on the peripheral surface of the drive roller or the driven roller, because, when there is no sheet between the drive roller and the driven roller, the drive roller and the driven roller rotate with their respective rubber surfaces in contact and their rotation axes not parallel.

Illustrative aspects of the disclosure provide a sheet conveying apparatus, which reduces lopsided wear on a peripheral surface of a drive roller or a driven roller facing the drive roller, and an image forming apparatus including the sheet conveying apparatus.

According to an aspect of the disclosure, a sheet conveying apparatus includes a bottom plate, a side restriction member, a drive roller, and a driven roller. The side restriction member is located on the bottom plate and extending in a sheet conveying direction in which a sheet is conveyed. The drive roller is rotatable about a first axis substantially orthogonal to the sheet conveying direction. The driven roller faces the drive roller and has a first end and a second end opposite to the first end. The first end is closer to the side restriction member than the second end. The driven roller is rotatable about a second axis. The second axis is inclined relative to the first axis such that the first end of the driven roller is located upstream relative to the second end of the driven roller in the sheet conveying direction. The driven roller includes a shaft portion and an elastic portion. The shaft portion is made of resin and has the second axis as a rotation center. The shaft portion has the first end and the second end of the driven roller in a direction of the second axis. The elastic portion is made of resin and has a cylindrical shape. The elastic portion is fitted over the shaft portion and has an outer peripheral surface in contact with a peripheral surface of the driven roller. The shaft portion of the driven roller integrally includes a first extending portion, a second extending portion, and an intermediate portion. The first extending portion extends from the elastic portion toward the first end of the driven roller. The second extending portion extends from the elastic portion toward the second end of the driven roller. The intermediate portion is located between the first extending portion and the second extending portion, the elastic portion being fitted over the intermediate portion. The first extending portion includes a first protruding portion protruding in a radial direction of the shaft portion relative to an outer peripheral surface of the intermediate portion by an amount smaller than a thickness of the elastic portion. The second extending portion includes a second protruding portion protruding in the radial direction of the shaft portion relative to the outer peripheral surface of the intermediate portion by an amount smaller than the thickness of the elastic portion. A first distance from the second axis to an outer peripheral surface of the first protruding portion is greater than a second distance from the second axis to an outer peripheral surface of the second protruding portion.

According to another aspect of the disclosure, an image forming apparatus includes a sheet conveying unit configured to convey a sheet and an image forming unit configured to form an image on the sheet conveyed by the sheet conveying unit. The sheet conveying unit includes the sheet conveying apparatus.

Thus, the sheet can be smoothly conveyed toward the side restriction member and lopsided wear on the outer peripheral surface of the driven roller can be reduced.

BRIEF DESCRIPTION OF THE DRAWINGS

Reference is made to the following description taken in connection with the accompanying drawings, like reference numerals being used for like corresponding parts in the various drawings.

DETAILED DESCRIPTION

An embodiment of the disclosure will be described with reference to the following drawings.

<General Configuration>

Figure 1:
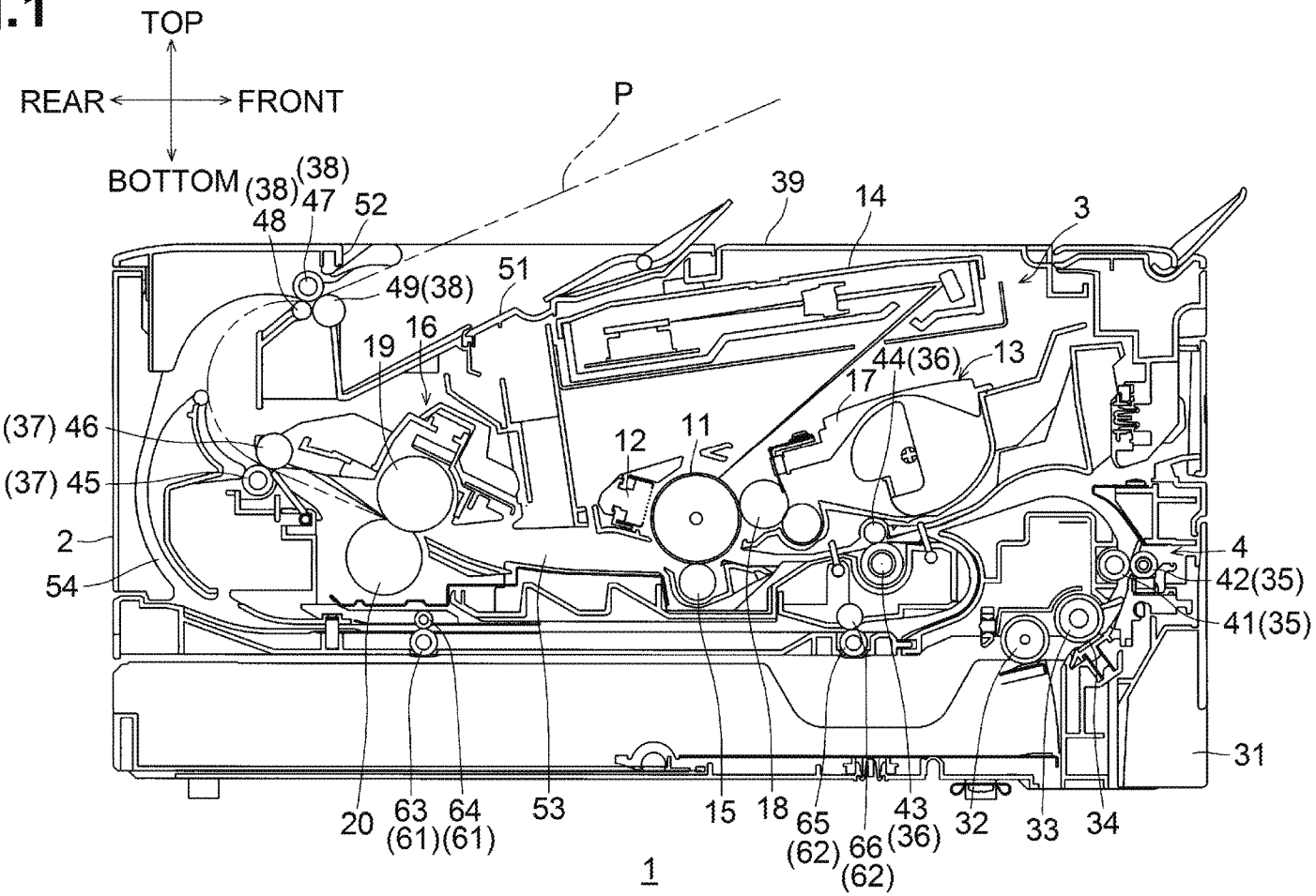
FIG. 1 is a sectional view of a laser printer according to an illustrative embodiment.

As illustrated in FIG. 1, a laser printer 1 as an example of an image forming apparatus is a monochrome laser printer. The laser printer 1 includes a main body casing 2. The main body casing 2 is substantially box-shaped, and accommodates inside an image forming unit 3 and a conveying unit 4.

The image forming unit 3 includes a photosensitive drum 11, a charger 12, a developing unit 13, an exposing unit 14, a transfer roller 15, and a fixing unit 16.

The photosensitive drum 11 is disposed rotatably about an axis extending in a width direction of the laser printer 1.

The charger 12 is disposed on a side of the photosensitive drum 11 opposite to the developing unit 13 relative to an axis of the photosensitive drum 11. The charger 12 is a scorotron-type charger including a wire or a grid.

In the following description, a side of the main body casing 2, relative to an axis of the photosensitive drum 11, where the charger 12 is disposed, refers to a rear side, and its opposite side, where the developing unit 13 is disposed, refers to a front side. The top or upper side, the bottom or lower side, the left or left side, and the right or right side are determined when the laser printer 1 is viewed from the front side.

The developing unit 13 is disposed in front of the photosensitive drum 11. The developing unit 13 includes a casing 17 for storing toner, and a developing roller 18 supported by the casing 17. The developing roller 18 is disposed rotatably about an axis extending in the width direction of the laser printer 1. The peripheral surface of the developing roller 18 is in contact with the peripheral surface of the photosensitive drum 11.

The exposure unit 14 is disposed above the photosensitive drum 11, the charger 12, and the developing unit 13. The exposure unit 14 includes a light source and a polygon mirror, and is configured to irradiate the peripheral surface of the photosensitive drum 11 with laser beam as modulated based on image data.

The transfer roller 15 is disposed below the photosensitive drum 11. The transfer roller 15 is rotatable about an axis extending in the width direction of the laser printer 1.

The fixing unit 16 is disposed at the rear of the charger 12. The fixing unit 16 includes a heat roller 19 and a pressure roller 20. The heat roller 19 is rotatable about an axis extending in the width direction of the laser printer 1. The pressure roller 20 is disposed below the heat roller 19 to the rear and is rotatable about an axis extending in the width direction of the laser printer 1. The peripheral surface of the heat roller 19 is in contact with the peripheral surface of the pressure roller 20.

The conveying unit 4 includes a sheet supply cassette 31, a pickup roller 32, a separation roller 33, a separation pad 34, conveying rollers 35, 36, 37, ejection rollers 38, and an ejection tray 39.

The sheet supply cassette 31 is disposed at a bottom portion of the main body casing 2. The sheet supply cassette 31 is pullable to the front side from the main body casing 2. The sheet supply cassette 31 accommodates a stack of sheets P.

The pickup roller 32 is disposed in an upper front end portion of the sheet supply cassette 31. The peripheral surface of the pickup roller 32 contacts an uppermost sheet P of the stack of sheets P accommodated in the sheet supply cassette 31.

The separation roller 33 and the separation pad 34 are disposed in front of the pickup roller 32. The separation roller 33 is rotatable about an axis extending in the width direction of the laser printer 1. The peripheral surface of the separation roller 33 is in contact with the separation pad 34 from behind and above.

The conveying rollers 35 are disposed in front of and above the separation roller 33. The conveying rollers 35 include a drive roller 41 and a driven roller 42. The drive roller 41 and the driven roller 42 are disposed with their peripheral surfaces in contact with each other and rotatable about their respective axes extending in the width direction of the laser printer 1.

The conveying rollers 36 are registration rollers disposed in front of the photosensitive drum 11 and the transfer roller 15. The conveying rollers 36 include a drive roller 43 and a driven roller 44. The drive roller 43 and the driven roller 44 are disposed with their peripheral surfaces in contact with each other and rotatable about their respective axes extending in the width direction of the laser printer 1.

The conveying rollers 37 are disposed at the rear of the fixing device 16 and above the pressure roller 20. The conveying rollers 37 include a drive roller 45 and a driven roller 46. The drive roller 45 and the driven roller 46 are disposed with their peripheral surfaces in contact with each other and rotatable about their respective axes extending in the width direction of the laser printer 1.

The ejection rollers 38 are disposed above the conveying rollers 37. The ejection rollers 38 include a drive roller 47 and two driven rollers 48, 49. The drive roller 47 and the driven rollers 48, 49 are disposed with their peripheral surfaces in contact with one another and rotatable about their respective axes extending in the width direction of the laser printer 1.

The ejection tray 39 is provided on an upper surface of the main body casing 2. A front portion of the ejection tray 39 is substantially perpendicular to a front surface of the main body casing 2 and extends in the front-rear direction and the width direction. A rear portion of the ejection tray 39 is provided with an inclined surface 51 and a wall surface 52. The inclined surface 51 is inclined downward to the rear. The wall surface 52 extends upward from the rear end of the inclined surface 51. Thus, the rear portion of the ejection tray 39 is recessed from the upper surface of the main body casing 2 in the form of substantially a triangle. The rear portion of the ejection tray 39 is constituted by the inclined surface 51. Part of the peripheral surface of the driven roller 49 protrudes to the front from the wall surface 52.

In printing, the conveying unit 4 conveys a sheet P to the image forming unit 3 where an image is formed on the sheet P.

When the pickup roller 32 in contact with the uppermost sheet P rotates counterclockwise in FIG. 1, the uppermost sheet P and a few subsequent sheets P are fed frontward from the sheet supply cassette 31. The sheets P are introduced into between the separation roller 33 and the separation pad 34, and only the uppermost sheet P passes through between the separation roller 33 and the separation pad 34. The sheet P is conveyed between the conveying rollers 35, the conveying rollers 36, the photosensitive drum 11 and the transfer roller 15, the heat roller 19 and the pressure roller 20 of the fixing unit 16, the conveying rollers 37, and then among the ejection rollers 38 in this order. The conveying rollers 35, 36, the photosensitive drum 11 and the transfer roller 15, the heat roller 19 and the pressure roller 20 of the fixing unit 16, the conveying rollers 37 and the ejection rollers 38 define a conveying path 53 shaped like a letter S in side view.

The photosensitive drum 11 is configured to rotate clockwise viewed in FIG. 1. The surface of the photosensitive drum 11 is uniformly charged by the charger 12 and then selectively exposed to laser beam from the exposing unit 14. This exposure selectively removes electric charges from the surface of the photosensitive drum 11 to form an electrostatic latent image on the surface of the photosensitive drum 11. The electrostatic latent image is developed into a toner image with toner supplied from the developing roller 18 of the developing unit 13.

The sheet P is conveyed between the photosensitive drum 11 and the transfer roller 15 when the toner image on the photosensitive drum 11 faces the transfer roller 15. The transfer roller 15 receives a transfer bias. When the sheet P passes through between the photosensitive drum 11 and the transfer roller 15, the toner image on the photosensitive drum 11 is transferred onto a first surface of the sheet P by the transfer bias. The sheet P having the toner image is conveyed toward the fixing unit 16. In the fixing unit 16, the sheet P passes through between the heat roller 19 and the pressure roller 20. The toner image is fixed onto the sheet P by heat and pressure.

The laser printer 1 has a simplex printing mode and a duplex printing mode. The simplex printing mode allows printing of a sheet P on a single surface. The duplex printing mode allows printing of a sheet P on both surfaces.

In the simplex printing mode, the sheet P having an image on a first surface is ejected by the conveying rollers 37 and the ejection rollers 38 to the ejection tray 39.

The main body casing 2 defines a reverse conveying path 54 inside. The reverse conveying path 54 extends downward from a point midway between the conveying rollers 37 and the ejection rollers 38 via a rear end portion of the main body casing 2, then frontward between the image forming unit 3 and the sheet supply cassette 31, and is connected to the conveying path 53 midway between the conveying rollers 35 and 36. First reverse conveying rollers 61 and second reverse conveying rollers 62 are provided on the reverse conveying path 54.

The first reverse conveying rollers 61 includes a drive roller 63 and a driven roller 64. The drive roller 63 and the driven roller 64 are disposed with their peripheral surfaces in contact with each other and rotatable about their respective axes extending in the width direction of the laser printer 1.

The second reverse conveying rollers 62 are disposed in front of the first reverse conveying rollers 61. The second reverse conveying rollers 62 includes a drive roller 65 and a driven roller 66. The drive roller 65 and the driven roller 66 are disposed with their peripheral surfaces in contact with each other and rotatable about their respective axes extending in the width direction of the laser printer 1.

In the duplex printing mode, the sheet P having an image on a first surface is conveyed to the reverse conveying path 54 by the ejection rollers 38 without being fully ejected onto the ejection tray 39. The sheet P is conveyed frontward on the reverse conveying path 54 and then to the conveying path 53 by the first reverse conveying rollers 61 and the second reverse conveying rollers 62. The sheet P is conveyed from the reverse conveying path 54 back through the conveying path 53, where the sheet P is conveyed between the photosensitive drum 11 and the transfer roller 15 with a second surface, which is blank, of the sheet P facing the photosensitive drum 11. The sheet P having an image on the second surface is ejected by the conveying rollers 37 and the ejection rollers 38 onto the ejection tray 39.

<Reverse Conveying Unit>

The laser printer 1 includes a reverse conveying unit 71 as an example of a sheet conveying apparatus. The reverse conveying unit 71 forms a part of the reverse conveying path 54 extending in the front-rear direction between the image forming unit 3 and the sheet supply cassette 31.

Figure 2:
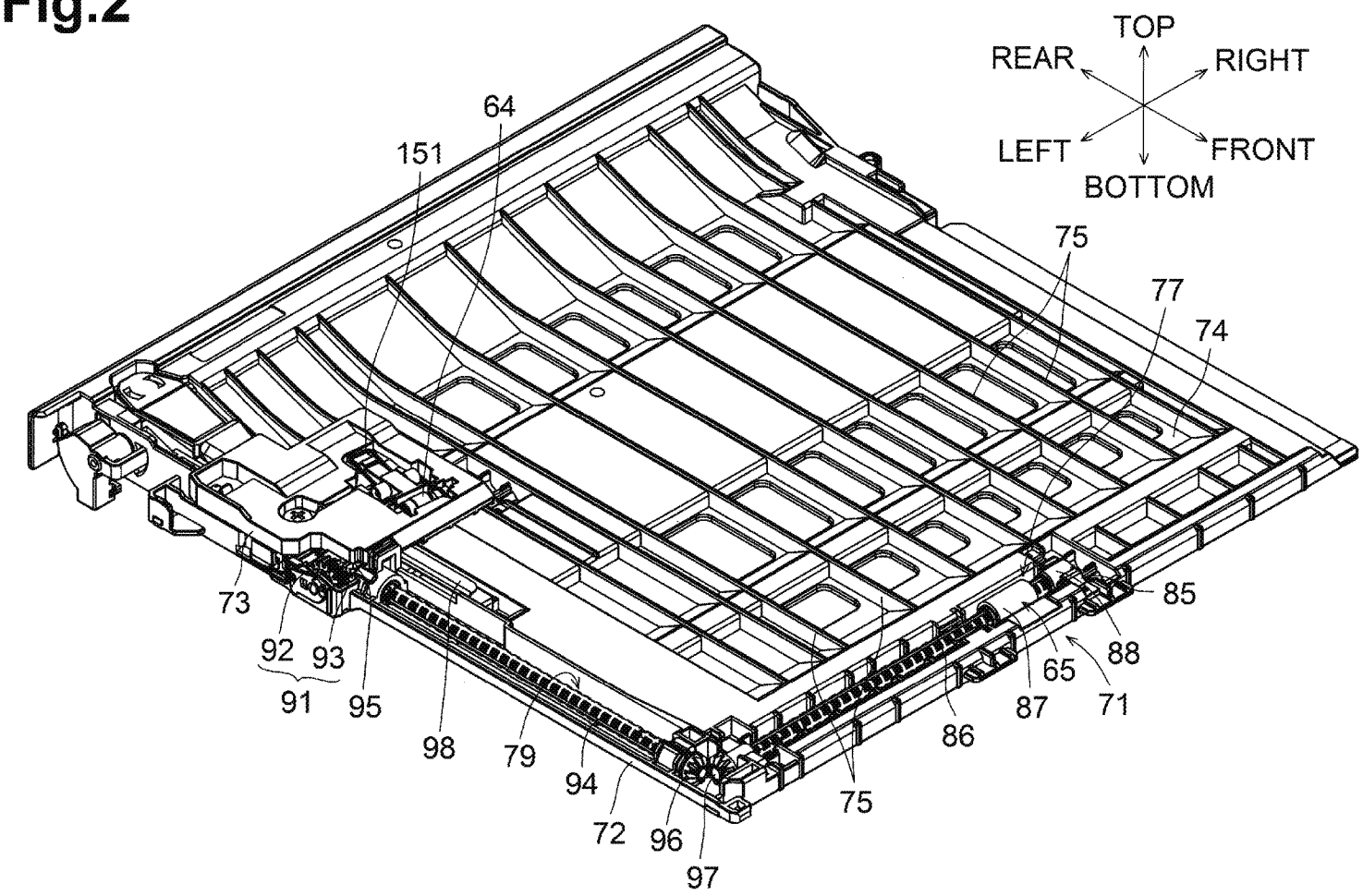
FIG. 2 is a perspective view of a reverse conveying unit in the laser printer illustrated in FIG. 1.
Figure 3:
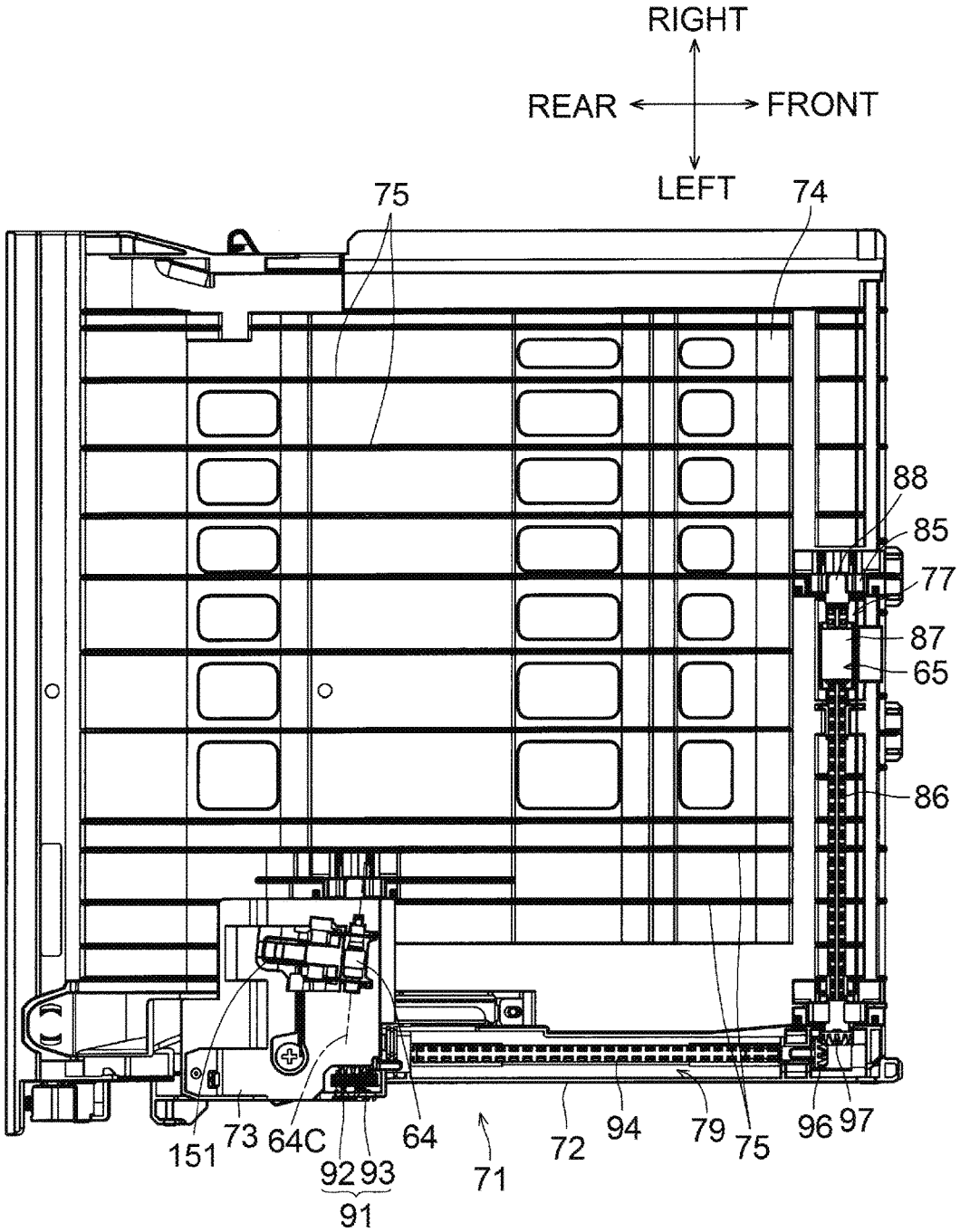
FIG. 3 is a plan view of the reverse conveying unit illustrated in FIG. 2.

As illustrated in FIGS. 2 and 3, the reverse conveying unit 71 includes a unit body 72 and a holder 73 attached to the unit body 72. The unit body 72 and the holder 73 are made of resin.

<Unit Body>

Figure 4:
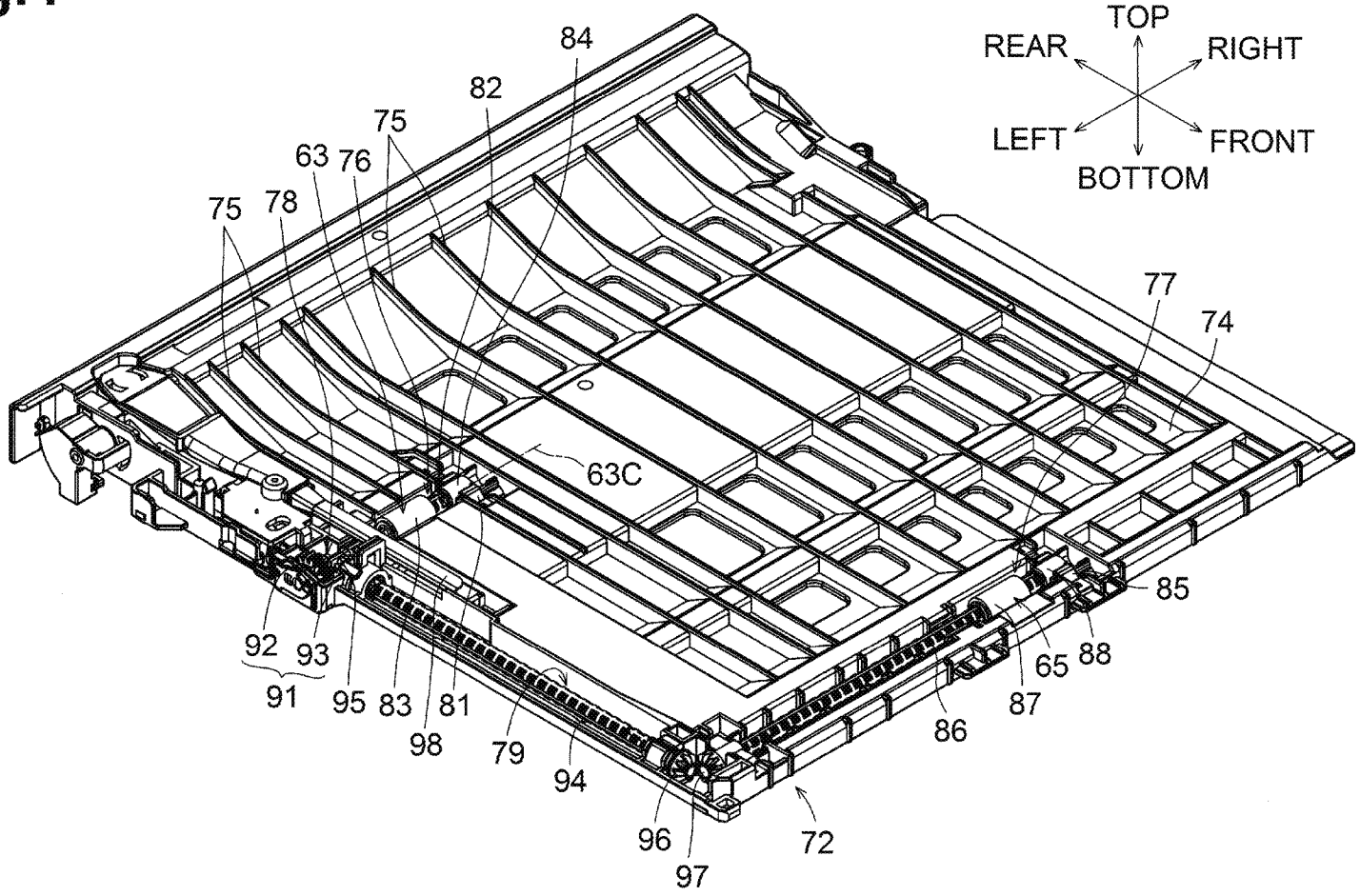
FIG. 4 is a perspective view of a unit body of the reverse conveying unit illustrated in FIG. 2.
Figure 5:
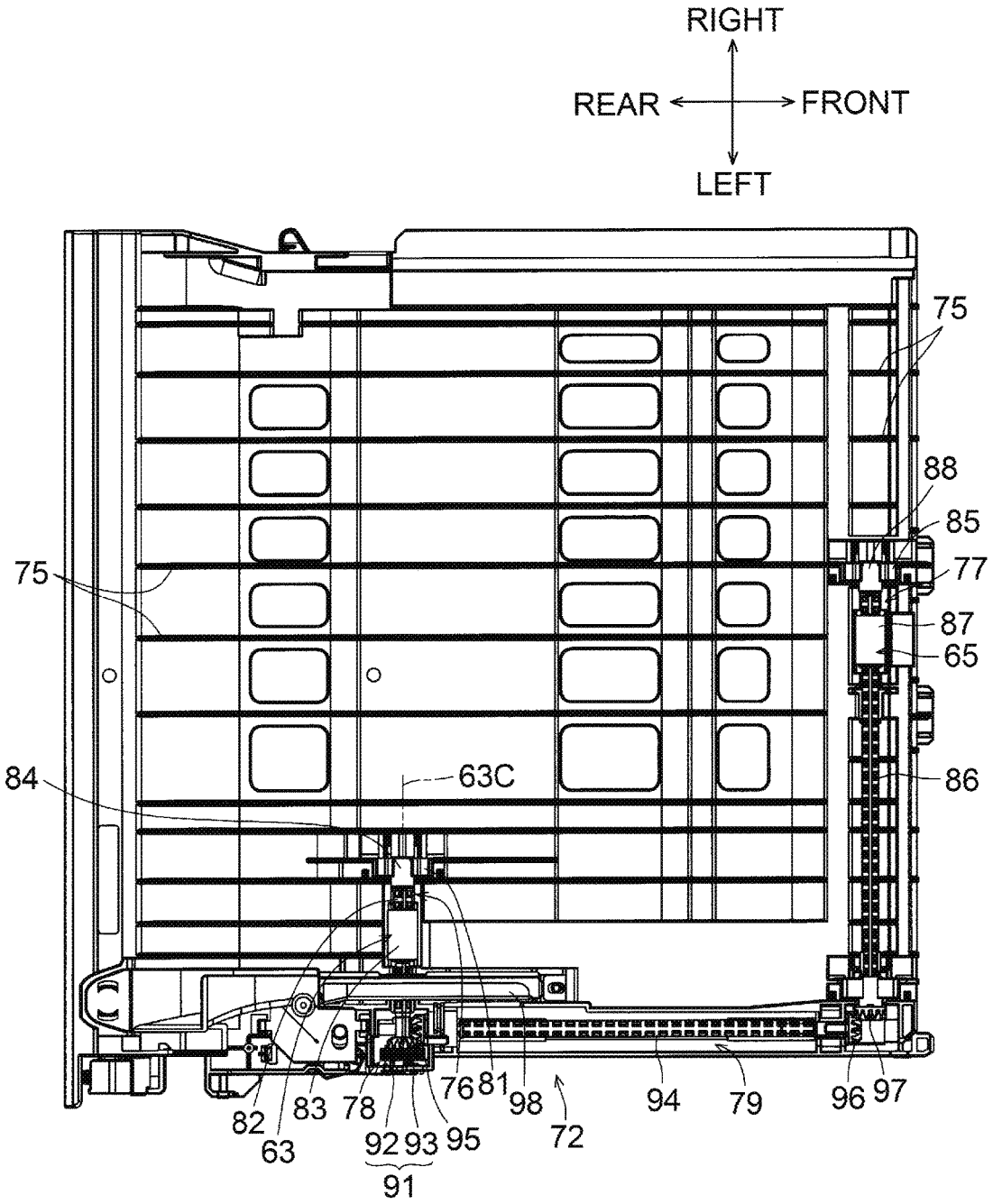
FIG. 5 is a plan view of the unit body illustrated in FIG. 4.

As illustrated in FIGS. 4 and 5, the unit body 72 includes a bottom plate 74 and plural ribs 75.

The bottom plate 74 extends in the front-rear direction and the width direction. The rear end portion of the bottom plate 74 is arcuately curved upward toward the rear.

The ribs 75 protrude upward from an upper surface of the bottom plate 74, are spaced apart from one another in the width direction, and extend parallel to a sheet conveying direction in which a sheet P is conveyed. Upper ends of the ribs 75 are flush with one another, defining the reverse conveying path 54.

The unit body 72 is provided with a first roller receiving portion 76, a second roller receiving portion 77, an input gear accommodating portion 78, and a drive shaft accommodating portion 79, which are grooves each having a bottom surface lower than the upper ends of the ribs 75.

The first roller receiving portion 76 is located at a central portion of the unit body 72 in the front-rear direction and at a position closer to the left end of the unit body 72. A bearing portion 81, which is open upward, is located at a right end portion of the first roller receiving portion 76. The first roller receiving portion 76 receives the drive roller 63 of the first reverse conveying rollers 61. The drive roller 63 includes a resin-made shaft portion 82 and a cylindrical rubber portion 83 fitted over the shaft portion 82. A collar member 84 is fixedly fitted over a right end portion of the shaft portion 82.

The collar member 84 is supported by the bearing portion 81 from below. The drive roller 63 is rotatable about an axis 63C, as an example of a first axis, which is the center line of the shaft portion 82. The peripheral surface of the rubber portion 83 partially protrudes upward relative to a surface including the upper ends of the ribs 75. A sheet P to be conveyed in contact with the upper ends of the ribs 75 in the reverse conveying path 54 contacts the peripheral surface of the rubber portion 83. The axis 63C is substantially parallel to the width direction.

The second roller receiving portion 77 is located at a front end portion of the unit body 72 and extends between a left end portion and a central portion of the unit body 72 in the width direction. A bearing portion 85, which is open upward, is located at a right end portion of the second roller receiving portion 77. The second roller receiving portion 77 receives the drive roller 65 of the second reverse conveying rollers. The drive roller 65 includes a resin-made shaft portion 86 and a cylindrical rubber portion 87 made of rubber and fitted over the shaft portion 86. A collar member 88 is fixedly fitted over a right end portion of the shaft portion 86. The collar member 88 is supported from below by the bearing portion 85. The drive roller 65 is rotatable about the shaft portion 86. The peripheral surface of the rubber portion 87 partially protrudes upward relative to a surface including the upper ends of the ribs 75. When a sheet P is conveyed in the reverse conveying path 54, the sheet P contacts the upper ends of the ribs 75 and the peripheral surface of the rubber portion 87.

The input gear accommodating portion 78 is located at the left end portion of the unit body 72 and to the left of the first roller receiving portion 76. The input gear accommodating portion 78 accommodates a resin-made input gear set 91. The input gear set 91 integrally includes a spur gear 92 and a bevel gear 93. The bevel gear 93 is disposed to the right of the spur gear 92 and is shaped like a circular truncated cone in which a diameter is gradually reduced toward the right. The input gear accommodating portion 78 is communicated with the first roller receiving portion 76. The shaft portion 82 of the drive roller 63 disposed in the first roller receiving portion 76 extends across the input gear accommodating portion 78 to the left and the left end portion of the shaft portion 82 is connected to the bevel gear 93 of the input gear set 91.

The drive shaft accommodating portion 79 is located at the left end portion of the unit body 72 and in front of the input gear accommodating portion 78. The drive shaft accommodating portion 79 is communicated with the input gear accommodating portion 78 and the second roller receiving portion 77. The input gear accommodating portion 79 accommodates a resin-made drive transmission shaft 94. The drive transmission shaft 94 extends in the front-rear direction in the input gear accommodating portion 78 and the input gear accommodating portion 79. A rear end portion of the drive transmission shaft 94 is connected to a bevel gear 95. A front end portion of the drive transmission shaft 94 is connected to a bevel gear 96. The bevel gear 95 engages the bevel gear 93.

The shaft portion 86 of the drive roller 65 received in the second roller receiving portion 77 extends to the input gear accommodating portion 79. A left end portion of the shaft portion 86 is connected to a bevel gear 97. The bevel gear 96 engages the bevel gear 97.

When a drive force from a motor (not illustrated) is transmitted to the input gear set 91, the input gear set 91 and the drive roller 63 of the first reverse conveying rollers 61 rotate together. The drive force transmitted to the input gear set 91 is transmitted via the bevel gear 95, the drive transmission shaft 94, the bevel gear 96, the bevel gear 97, and the shaft portion 86, to the drive roller 65, and the drive roller 65 rotates.

The unit body 72 is provided with a long-length side restriction member 98. The side restriction member 98 is located to the right of the input gear accommodating portion 78 and extends in the front-rear direction over the first roller receiving portion 76.

<Holder>

Figure 6:
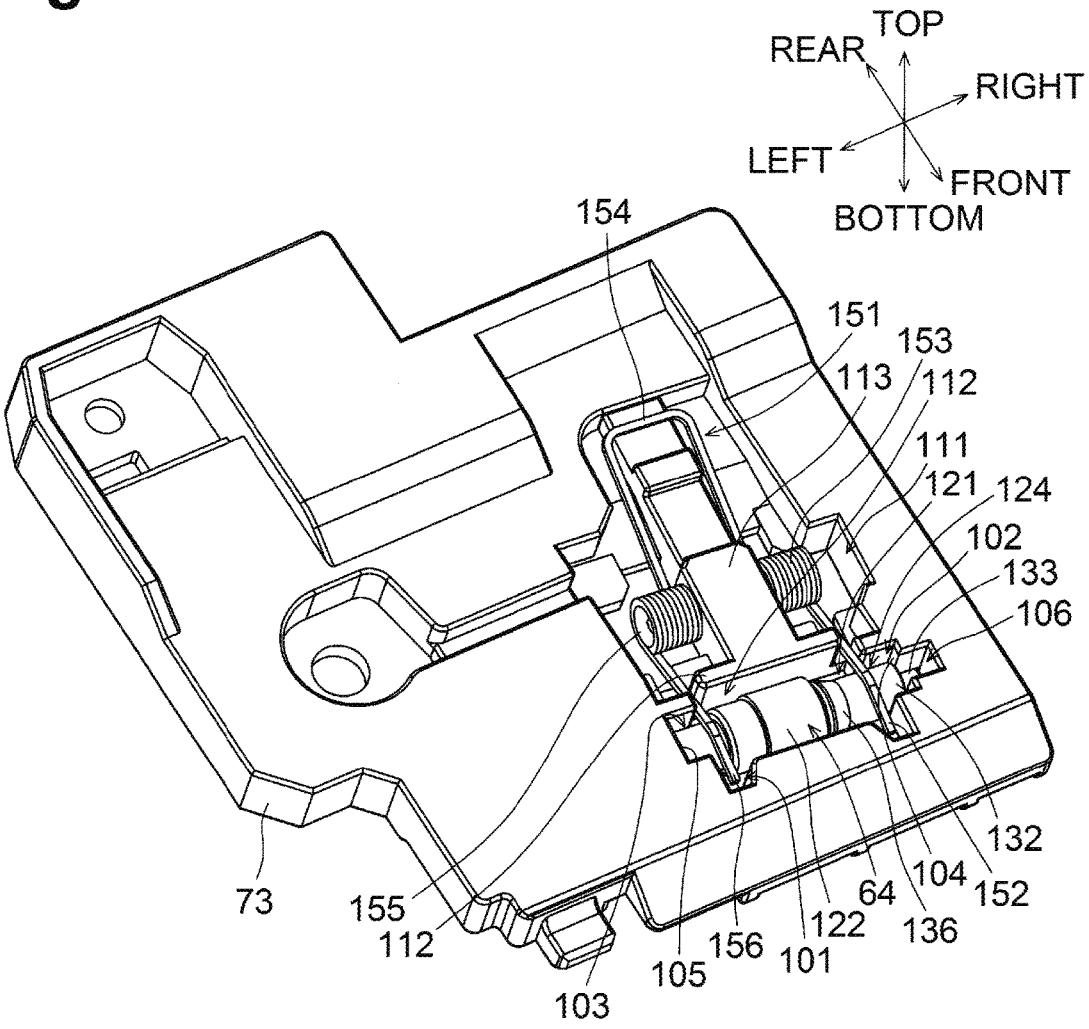
FIG. 6 is a perspective view of a holder of the reverse conveying unit illustrated in FIG. 2.
Figure 7:
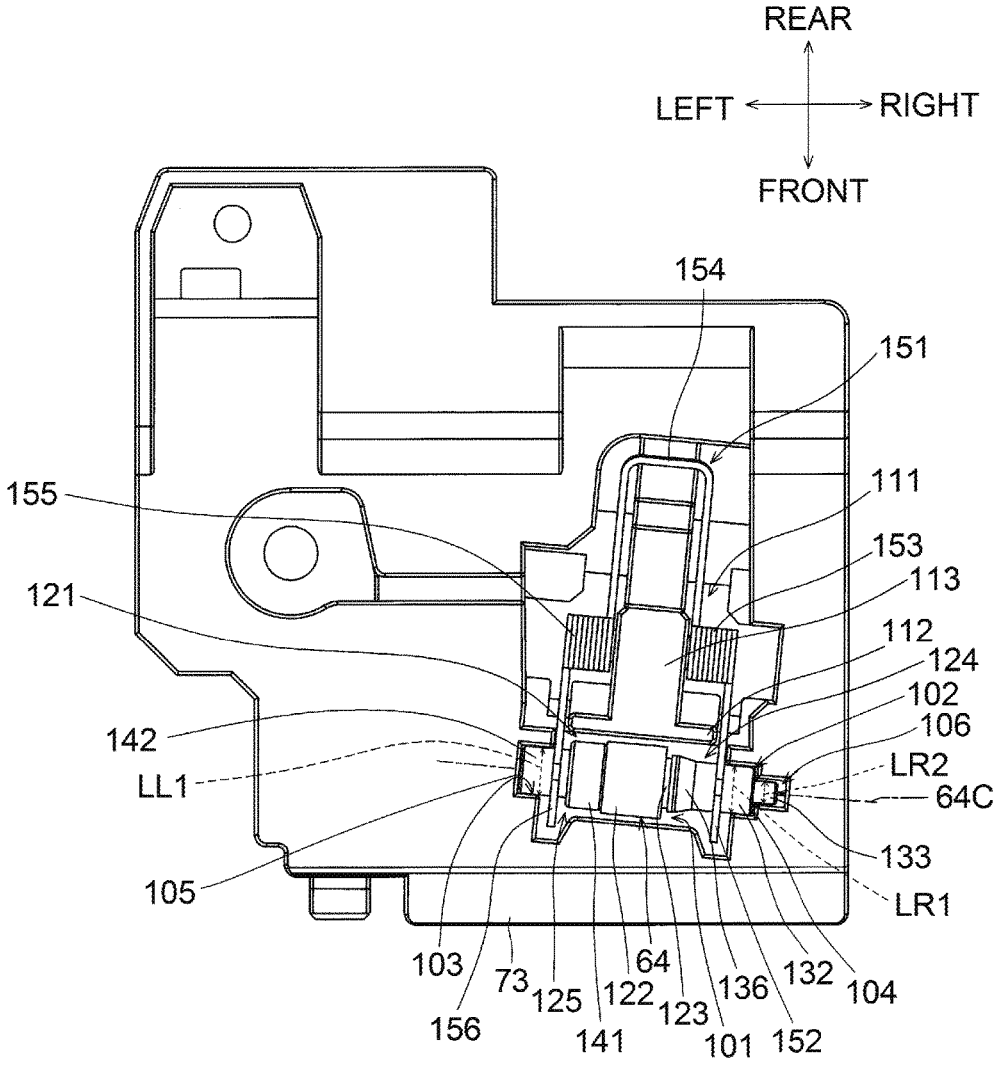
FIG. 7 is a plan view of the holder illustrated in FIG. 6.

As illustrated in FIGS. 6 and 7, the holder 73 is shaped like a rectangle void of a front left corner and a rear right corner.

A front right end portion of the holder 73 has a first opening 101 passing therethrough vertically. A right bearing portion 102 as an example of a first bearing portion is provided to the left of the first opening 101 and a left bearing portion 103 as an example of a second bearing portion is provided to the right of the first opening 101. The right bearing portion 102 and the left bearing portion 103 are recessed from an upper surface of the holder 73 and communicated with the first opening 101. A right end surface 104 of the right bearing portion 102 and a left end surface 105 of the left bearing portion 103 are parallel to each other, and inclined toward the left in the rear-to-front direction. The right bearing portion 102 has a length LR1 extending in a direction parallel to the right end surface 104. The length LR1 is substantially equal to an outside diameter DR2 of a right holding portion 132 of the driven roller 64. The left bearing portion 103 has a length LL1 extending in a direction parallel to the left end surface 105. The length LL1 is substantially equal to an outside diameter DL2 of a left holding portion 142 of the driven roller 64. The length LR1 of the right bearing potion 102 is equal to the length LL1 of the left bearing portion 103. A small-dimension portion 106 is located to the right of the right bearing portion 102 and is communicated with the right bearing portion 102. The small-dimension portion 106 has a length LR2 extending in the direction parallel to the right end surface 104. The length LR2 is smaller than the length LR1 of the right bearing portion 102.

The holder 73 has a second opening 111, which passes therethrough vertically and is provided at the rear of the first opening 101. The first opening 101 and the second opening 111 are separated by a separation wall portion 112. The separation wall portion 112 is combined with a spring holding portion 113. The spring holding portion 113 extends rearward from a central portion of the separation wall portion 112 in a longitudinal direction thereof.

As illustrated in FIGS. 2 and 3, the holder 73 is attached to the unit body 72 with a screw.

<Driven Roller>

The driven roller 64 of the first reverse conveying rollers 61 is accommodated in a driven roller accommodating portion defined by the first opening 101, the right bearing portion 102, the left bearing portion 103, and the small-diameter portion 106, which are all provided in the holder 73.

Figure 8:
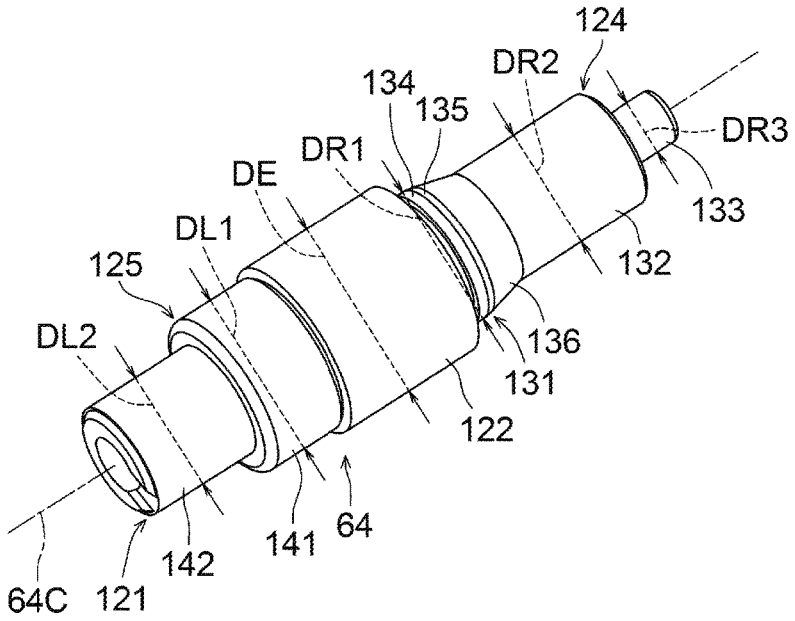
FIG. 8 is a perspective view of a driven roller in the holder illustrated in FIG. 6.
Figure 9:
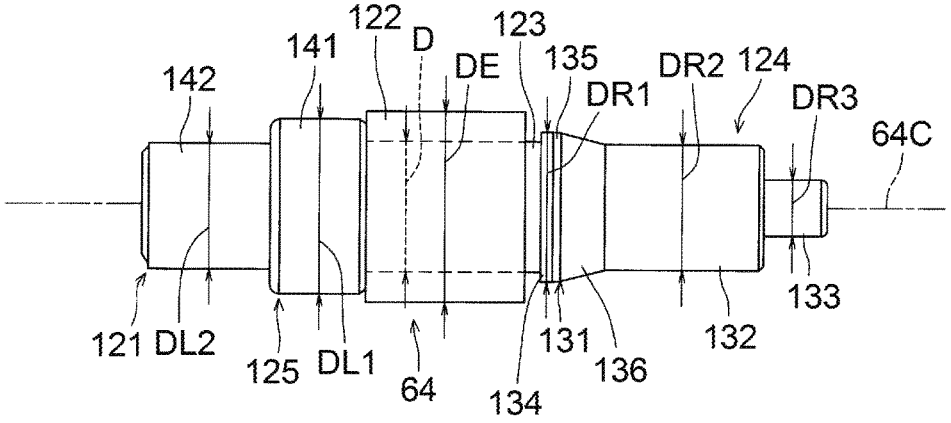
FIG. 9 is a plan view (viewed in a direction orthogonal to an axial direction) of the driven roller illustrated in FIG. 8.

As illustrated in FIGS. 8 and 9, the driven roller 64 includes a resin-made shaft portion 121 and a cylindrical rubber portion 122, as an example of an elastic portion, which is fitted over the shaft portion 121.

The shaft portion 121 integrally includes an intermediate portion 123, a right extending portion 124 as an example of a second extending portion, and a left extending portion 125 as an example of a first extending portion. Center lines of the intermediate portion 123, the right extending portion 124, and the left extending portion 125 are aligned with one another, forming an axis 64C, as an example of a second axis, of the shaft portion 121.

The intermediate portion 123 has a cylindrical outer surface over which the rubber portion 122 is fitted.

The right extending portion 124 extends rightward from the intermediate portion 123. The right extending portion 124 includes a right protruding portion 131 as an example of a second protruding portion, a right holding portion 132 as an example of a second holding portion, and a small-diameter portion 133.

The right protruding portion 131 is adjacent to the intermediate portion 123. The right protruding portion 131 has a cylindrical surface 134, a first inclined surface 135, and a second inclined surface 136 as an example of an inclined surface. The cylindrical surface 134 has an outside diameter DR1 (of 4.71 mm, for example) greater than an outside diameter D (or a diameter of the outer surface) of the intermediate portion 123. The cylindrical surface 134 is continuous with the first inclined surface 135, which is inclined such that a more right portion of the first inclined surface 135 is closer to the axis 64C than a more left portion thereof. The first inclined surface 135 is continuous with the second inclined surface 136, which is inclined at a greater inclination than the first inclined surface 135 such that a more right portion of the second inclined surface is closer to the axis 64C than a more left portion thereof The right holding portion 132 is adjacent to the right protruding portion 131. The right holding portion 132 is cylindrical and has an outer peripheral surface, which is continuous with the second inclined surface 136.

The small-diameter portion 133 is adjacent to the right holding portion 132. The small-diameter portion 133 is cylindrical and has an outer peripheral surface with an outside diameter DR3, which is smaller than the outside diameter DR2 of the right holding portion 132.

The left extending portion 125 extends leftward from the intermediate portion 123. The left extending portion 125 includes a left protruding portion 141 as an example of a first protruding portion, and a left holding portion 142 as an example of a first holding portion.

The left protruding portion 141 is adjacent to the intermediate portion 123. The left protruding portion 141 is cylindrical and has an outer peripheral surface with an outside diameter DL1 (of 5.5 mm, for example), which is greater than the outside diameter D of the intermediate portion 123 and the outside diameter DR1 of the cylindrical surface 134.

The left holding portion 142 is adjacent to the left protruding portion 141. The left holding portion 142 is cylindrical and has an outer peripheral surface with an outside diameter DL2, which is equal to the outside diameter DR2 of the right holding portion 132.

With the rubber portion 122 fitted over the intermediate portion 123, an inner peripheral surface of the cylindrical rubber portion 122 adheres to the outer peripheral surface of the intermediate portion 123, the thickness of the rubber portion 122 is greater than a difference between the outer peripheral surface of the intermediate portion 123 and the outer peripheral surface of the left protruding portion 141, and an outside diameter DE of the rubber portion 122 is greater than the outside diameter DL1 of the left protruding portion 141. Thus, the right protruding portion 131 and the left protruding portion 141 protrude in a radial direction of the shaft portion 121 relative to the outer peripheral surface of the intermediate portion 123 by an amount smaller than the thickness ((DE−D)/2) of the rubber portion 122.

As illustrated in FIGS. 6 and 7 in which the driven roller 64 is accommodated in the driven roller accommodating portion of the holder 73, the right holding portion 132 and the left holding portion 142 are engaged, with play, in the right bearing portion 102 and the left bearing portion 103, respectively. This allows the driven roller 64 held by the holder 73 to rotate about the axis 64C, as an example of a second axis, which is a center line of the shaft portion 121, with the outer peripheral surface of the rubber portion 122 partially protruding downward from the first opening 101 of the holder 73. As the right bearing portion 102 is located closer to the front and the right than the left bearing portion 103, the axis 64C of the driven roller 64 is inclined relative to the width direction such that a more right portion of the driven roller 64 is closer to the front than a more left portion thereof The small-diameter portion 133 is engaged with play in the small-dimension portion 106 of the holder 73.

<Helical Torsion Spring>

A helical torsion spring 151 as an example of an urging member is provided in the second opening 111 of the holder 73.

The helical torsion spring 151 is made by winding and bending a metal wire, and integrally includes a right pressing portion 152, a right winding portion 153, a connection portion 154, a left winding portion 155, and a left pressing portion 156. The right pressing portion 152 extends in a direction orthogonal to the axis 64C of the driven roller 64 in plan view. The right winding portion 153 is located at the rear of the right pressing portion 152 and has coils that are subjected to twisting about a line extending parallel to the axis 64C. The connection portion 154 extends to the rear from the right winding portion 153, bends to the left and then extends to the front. The left winding portion 155 is located at the front of a left end portion of the connection portion 154 and has coils that are subjected to twisting about a line extending parallel to the axis 64C. The left pressing portion 156 extends in the direction orthogonal to the axis 64C of the driven roller 64 in plan view.

The right winding portion 153 and the left winding portion 155 are held by the spring holding portion 113 of the holder 73. The right pressing portion 152 and the left pressing portion 156 are in contact with, from above, the right holding portion 132 and the left holding portion 142 of the driven roller 64, respectively. Thus, an elastic force of the helical torsion spring 151 presses the driven roller 64 against the right bearing portion 102 and the left bearing portion 103 of the holder 73. The helical torsion spring 151 held by the holding portion 113 is symmetrical in shape relative to a line extending in the direction orthogonal to the axis 64C of the driven roller 64 in plan view.

The drive roller 63 of the first reverse conveying rollers 61 is rotatable about the axis 63C. The driven roller 64 is rotatable about the axis 64C. The axis 64C of the driven roller 64 is inclined relative to the width direction such that a more right portion of the driven roller 64 is closer to the front than a more left portion thereof The driven roller 64 includes the shaft portion 121 having the axis 64C which is a center line, and the rubber portion 122 made of an elastic material. The shaft portion 121 includes the intermediate portion 123 over which the rubber portion 122 is fitted, the left extending portion 125 extending to the left in the width direction from the intermediate portion 123, and the right extending portion 124 extending to the right in the width direction from the intermediate portion 123. The driven roller 64 is disposed such that the outer peripheral surface of the rubber portion 122 contacts the peripheral surface of the drive roller 63.

A sheet P goes into between the outer peripheral surface of the rubber portion 122 and the peripheral surface of the drive roller 63, receiving a conveying force from the drive roller 63 and the driven roller 64. As the rubber portion 122 is made of an elastic material, frictional resistance between a sheet P and the rubber portion 122 is great, and thus the rubber portion 122 applies a favorable conveying force to the sheet P. The axis 64C of the driven roller 64 is inclined relative to the width direction. The conveying force applied by the rubber portion 122 causes the sheet P to move to the left side as the sheet P is conveyed downstream in the conveying direction.

The sheet P moved to the left side contacts the side restriction member 98 at which the sheet P cannot move further to the left side. Consequently, the position of the sheet P in the width direction can be maintained at a fixed position.

The axis 64C is inclined relative to the axis 63C such that a more left portion of a sheet P is located more upstream in the sheet conveying direction. Thus, during rotation of the drive roller 63 and the driven roller 64, a left half of the rubber portion 122 has a greater pressing force against the peripheral surface of the drive roller 63 than a right half of the rubber portion 122.

The right extending portion 124 and the left extending portion 125 respectively includes the right protruding portion 131 and the left protruding portion 141, which protrude relative to the outer peripheral surface of the intermediate portion 123. The amount of protrusion of the right protruding portion 131 ((DR1−D)/2) and the amount of protrusion of the left protruding portion 141 ((DL1−D)/2) are smaller than the thickness of the rubber portion 122 ((DE−D)/2), and a distance from the axis 64C to the outer peripheral surface of the left protruding portion 141 (DL1/2) is greater than a distance from the axis 64C to the outer peripheral surface of the right protruding portion 131 (DR1/2). As the left half of the rubber portion 122 has a pressing force against the peripheral surface of the drive roller 63 greater than the right half of the rubber portion 122, the left half of the rubber portion 122 is subjected to wear more than the right half of the rubber portion 122. When the thickness of the rubber portion 122 is reduced to the position of the peripheral surface of the left protruding portion 141 as wear continues, the peripheral surface of the drive roller 63 contacts the left protruding portion 141. Then, the pressing force of the rubber portion 122 against the peripheral surface of the drive roller 63 becomes small, which protects the peripheral surface of the rubber portion 122 from further wear.

Thus, the sheet P can be smoothly conveyed toward one side, e.g., the side restriction member 98 of the reverse conveying unit 71, and the peripheral surface of the driven roller 64 can be prevented from further lopsided wear.

The rubber portion 122 can be easily attached to the shaft portion 121 by fitting the rubber portion 122 around the shaft portion 121 from the right side thereof including the right protruding portion 131 with a smaller protruding amount than the left protruding portion 141.

The right protruding portion 131 has the first inclined surface 135 and the second inclined surface 136, which are each inclined such that a more right portion of the right protruding portion 131 is closer to the center line or the axis 64C than a more left portion thereof. By fitting the rubber portion 122 around the shaft portion 121 from the right side thereof having smaller diameters, the rubber portion 122 can be favorably deformed. Thus, the rubber portion 122 can be easily fitted over the shaft portion 121.

The rubber portion 122 is located between the left protruding portion 141 and the right protruding portion 131, which both protrude relative to the outer peripheral surface of the intermediate portion 123. The left protruding portion 141 and the right protruding portion 131 function as stoppers to prevent the rubber portion 122 from coming off both ends of the shaft portion 121. This configuration eliminates the need to additionally provide such stoppers for preventing the rubber portion 122 from coming off the shaft portion 121, which results in a reduction in the number of parts required and a simplified structure.

The right extending portion 124 and the left extending portion 125 includes the right holding portion 132 and the left holding portion 142, respectively. The holder 73 is provided with the right bearing portion 102 and the left bearing portion 103. By engaging the right holding portion 132 and the left holding portion 142 in the right bearing portion 102 and the left bearing portion 103, respectively, the driven roller 64 is rotatably held by the holder 73.

Further, the right extending portion 124 is provided with the small-diameter portion 133 protruding to the right from the right holding portion 132 and having a diameter smaller than the right holding portion 132 and the left holding portion 142. The holder 73 is provided with the small-dimension portion 106. When the small-diameter portion 133 is engaged in the small-dimension portion 106, the driven roller 64 is correctly attached to the holder 73. This structure reduces the possibility that the driven roller 64 is attached in the wrong orientation relative to the holder 73.

The right holding portion 132 and the left holding portion 142 are cylindrical and have the respective outer peripheral surfaces having the same diameter. The holder 73 includes the helical torsion spring 151. The helical torsion spring 151 is symmetrical in shape relative to a line extending in the direction orthogonal to the axis 64C of the driven roller 64 in plan view. The right pressing portion 152 and the left pressing portion 156 are located at respective ends of the helical torsion spring 151, and in contact with, from above, the right holding portion 132 and the left holding portion 142 of the driven roller 64, respectively. The symmetrically shaped helical torsion spring 151 allows the right pressing portion 152 and the left pressing portion 156 to evenly press the right holding portion 132 and the left holding portion 142, respectively, which reduces the lopsided wear on the peripheral surface of the driven roller 64.

<Modifications>

While the illustrative embodiment of the disclosure has been described, the disclosure will be applicable to other embodiments.

The above embodiment shows, but is not limited to that the right protruding portion 131 and the left protruding portion 141 are provided along the entire circumference of the shaft portion 121. Each of the right protruding portion 131 and the left protruding portion 141 may be plural protrusions spaced apart and arranged along the circumference of the shaft portion 121.

The above embodiment shows, but is not limited to that the right extending portion 124 includes the small-diameter portion 133 having a diameter smaller than the right holding portion 132 and the left holding portion 142. The left extending portion 125 may include the small-diameter portion. The small-diameter portion may not have a smaller diameter than the right holding portion 132 and the left holding portion 142. The small-diameter portion may have a greater diameter than the right holding portion 132 and the left holding portion 142 if the outside diameters of the right holding portion 132 and the left holding portion 142 are different.

The above embodiment shows, but is not limited to the rubber portion 122 made of rubber as an example of an elastic portion. The elastic portion may be made of other elastic material other than rubber.

The above embodiment shows, but is not limited to the laser printer 1 as an example of an image forming apparatus. The disclosure may be applicable to other types of image forming apparatus such as an ink jet printer.

Illustrative embodiments described above are merely examples. Various changes, arrangements and modifications may be applied therein without departing from the spirit and scope of the disclosure.

What is claimed is:

1. A sheet conveying apparatus comprising:

a bottom plate;

a side restriction member located on the bottom plate and extending in a sheet conveying direction in which a sheet is conveyed;

a drive roller rotatable about a first axis substantially orthogonal to the sheet conveying direction; and a driven roller facing the drive roller and having a first end and a second end opposite to the first end, the first end being closer to the side restriction member than the second end, the driven roller being rotatable about a second axis, the second axis being inclined relative to the first axis such that the first end of the driven roller is located upstream relative to the second end of the driven roller in the sheet conveying direction, wherein the driven roller includes:

a shaft portion made of resin and having the second axis as a rotation center, the shaft portion having the first end and the second end of the driven roller in a direction of the second axis; and an elastic portion made of an elastic material and having a cylindrical shape, the elastic portion being fitted over the shaft portion and having an outer peripheral surface in contact with a peripheral surface of the drive roller, wherein the shaft portion of the driven roller integrally includes:

a first extending portion extending from the elastic portion toward the first end of the driven roller;

a second extending portion extending from the elastic portion toward the second end of the driven roller; and an intermediate portion located between the first extending portion and the second extending portion, the elastic portion being fitted over the intermediate portion, wherein the first extending portion includes a first protruding portion protruding in a radial direction of the shaft portion relative to an outer peripheral surface of the intermediate portion by an amount smaller than a thickness of the elastic portion, wherein the second extending portion includes a second protruding portion protruding in the radial direction of the shaft portion relative to the outer peripheral surface of the intermediate portion by an amount smaller than the thickness of the elastic portion, and wherein a first distance from the second axis to an outer peripheral surface of the first protruding portion is greater than a second distance from the second axis to an outer peripheral surface of the second protruding portion.

2. The sheet conveying apparatus according to claim 1, wherein the second protruding portion of the second extending portion of the driven roller has an inclined surface such that a protruding amount relative to the outer peripheral surface of the intermediate portion is reduced toward the second end of the driven roller.

3. The sheet conveying apparatus according to claim 1, further comprising a holder holding the driven roller rotatably, wherein the first extending portion of the driven roller includes a first holding portion having a cylindrical outer peripheral surface, the first holding portion being located at a portion of the shaft portion closer to the first end of the driven roller than the first protruding portion, wherein the second extending portion includes a second holding portion having a cylindrical outer peripheral surface, the second holding portion being located at a portion of the shaft portion closer to the second end of the driven roller than the second protruding portion, and wherein the holder includes a first bearing portion receiving the first holding portion and a second bearing portion receiving the second holding portion.

4. The sheet conveying apparatus according to claim 3, wherein the shaft portion of the driven roller includes a small-diameter portion having a cylindrical outer peripheral surface and a smaller diameter than the first holding portion and the second holding portion, and wherein the small-diameter portion of the shaft portion is located at an end portion of one of the first extending portion and the second extending portion in the direction of the second axis, the end portion including a corresponding one of the first end and the second end of the driven roller.

5. The sheet conveying apparatus according to claim 3, wherein the first holding portion has an outside diameter equal to an outside diameter of the second holding portion.

6. The sheet conveying apparatus according to claim 5, further comprising an urging member configured to urge the first holding portion and the second holding portion toward the first bearing portion and the second bearing portion, respectively.

7. The sheet conveying apparatus according to claim 1, wherein the first protruding portion of the shaft portion is provided along a circumference of the shaft portion.

8. The sheet conveying apparatus according to claim 3, wherein the first bearing portion and the second bearing portion are recessed from an upper surface of the holder.

9. An image forming apparatus comprising:

a sheet conveying unit configured to convey a sheet; and an image forming unit configured to form an image on the sheet conveyed by the sheet conveying unit, wherein the sheet conveying unit includes the sheet conveying apparatus according to claim 1.

* * * * *